United States Patent [19]

Knorr

[11] Patent Number: 5,073,453

[45] Date of Patent: Dec. 17, 1991

[54] HIGH TENACITY NYLON YARN

[75] Inventor: Raymond S. Knorr, Pensacola, Fla.

[73] Assignee: Monsanto Company, St. Louis, Mo.

[21] Appl. No.: 452,084

[22] Filed: Dec. 18, 1989

[51] Int. Cl.[5] ..... D02G 3/00

[52] U.S. Cl. ..... 428/373; 428/364; 57/243

[58] Field of Search ..... 428/364, 373; 57/243

[56] References Cited

U.S. PATENT DOCUMENTS

| | | | |
|---|---|---|---|
| 3,090,997 | 5/1963 | Au | 57/902 X |
| 3,548,584 | 12/1970 | Silverman et al. | 57/140 |
| 3,551,548 | 12/1970 | Brignac et al. | 264/234 |
| 3,564,835 | 2/1971 | Keefe, Jr. et al. | 57/902 X |
| 4,496,630 | 1/1985 | Kurita et al. | 57/902 X |
| 4,701,377 | 10/1987 | Kurita et al. | 264/210.7 X |
| 4,758,472 | 7/1988 | Kitamura | 428/364 |

*Primary Examiner*—Lorraine T. Kendell

*Attorney, Agent, or Firm*—John W. Whisler

[57] ABSTRACT

A process for producing high tenacity nylon yarn is described. The process comprises a melt-spinning step for producing an as-spun yarn, a solid state polymerization step for increasing the $\overline{M}w$ and changing the crystalline characteristics of the nylon polymer of the as-spun yarn, and a drawing step for increasing the tenacity of the yarn.

7 Claims, No Drawings

HIGH TENACITY NYLON YARN

This invention relates to high tenacity nylon yarns and to a novel process for producing such yarns. The term "high tenacity nylon yarn(s)", as used herein, means nylon yarn(s) having a tenacity of at least 10 grams per denier (gpd). The yarns are particularly useful for making tire cords.

Nylon tire yarns typically have tenacities in the range of 8.5 to 9.5 gpd. In commercial practice, the yarns are made by melt spinning a fiber-forming nylon polymer to provide an as-spun yarn that is hot drawn either in-line with melt spinning before the yarn is collected (i.e. wound onto a bobbin) or in a separate operation. By "as-spun" yarn is meant an essentially undrawn yarn having little or no molecular orientation. Conventionally, the as-spun yarn is drawn between two sets of rolls, the second of which is operated at a higher peripheral speed than the first, under conditions of yarn temperature and draw ratio to achieve the highest possible tenacity without causing significant filament breakage. The draw ratio is calculated by dividing the peripheral speed of the second set of rolls by that of the first set of rolls.

In the past, efforts to increase the tenacity of nylon tire yarn to a level of at least above 10 gpd has been unsuccessful.

SUMMARY OF THE INVENTION

The present invention provides a process for producing high tenacity nylon yarns from conventional fiber-forming nylon polymer. In general, the process comprises a melt spinning step, a solid state polymerization (SSP) step and a drawing step. Specifically, the process comprises:

(a) melt-spinning an as-spun yarn from fiber-forming nylon polymer containing a solid state polymerization catalyst therefor;

(b) solid state polymerizing the as-spun yarn in an atmosphere that is inert with respect to the nylon polymer and under conditions of time and temperature, wherein the amount of the catalyst and the conditions employed are selected to increase the weight average molecular weight (Mw) of the nylon polymer to a value of at least 70,000 and to change the morphology of the nylon polymer; and (c) drawing the resulting solid state polymerized as-spun nylon yarn under conditions of yarn temperature and draw ratio so as to provide a yarn having a tenacity of at least 10 gpd without causing significant filament breakage.

Solid state polymerization (SSP) has previously been used in conjunction with the preparation of nylon yarns. For example, U.S. Pat. Nos. 3,551,548 and 3,548,584 disclose SSP of drawn nylon yarn for the purpose of increasing the molecular weight of the drawn yarn. However, in these instances the tenacity of the yarns was not significantly increased and in some instances was actually reduced. U.S. Pat. No. 3,548,584 discloses that attempts to melt-spin nylon yarn from nylon flake that has been subjected to SSP for the purpose of providing high molecular weight yarn resulted in major problems with respect to degradation of the nylon polymer and difficulties in drawing the yarn. Of course, SSP of flake cannot be used in conjunction with integrated processes Where melt-polymerization is coupled With melt-spinning.

The process of the present invention differs from conventional processes for making nylon tire yarn in that the as-spun yarn is subjected to solid state polymerization prior to being drawn. The SSP step provides an as-spun yarn having certain morphology characteristics which permits the yarn to be drawn at a higher temperature than conventional yarn and, therefore, to a higher draw ratio which, in turn, provides yarn having a higher tenacity. Normally, as-spun nylon tire yarn displays a single crystalline endotherm by Differential Scanning Calorimeter (DSC), whereas the solid state polymerized, as-spun nylon yarn described herein displays a different morphology. Specifically, the solid state polymerized, as-spun nylon yarn displays either two crystalline endotherms or a single sharply defined crystalline endotherm which is broader than that displayed by normal as-spun nylon yarn and extends below the temperature of that of normal as-spun nylon yarn. While the exact mechanism by which the process of the present invention provides high tenacity nylon yarn is not completely understood, it is believed that this difference in the morphology characteristics is a critical factor. The morphology characteristics are achieved by subjecting the as-spun nylon yarn to SSP under conditions of elevated temperature and time that increase the $\overline{M}w$ of the nylon to a value of at least 70,000 and preferably to a value of at least 100,000.

DESCRIPTION OF THE PREFERRED EMBODIMENTS

The steps of the process of the present invention (i.e. melt polymerization, SSP and drawing) may be carried out in a conventional manner.

Any of the fiber-forming nylon polymers described in the art may be used in practicing the present invention. However, preferably, the nylon present invention. However, preferably, the nylon polymer is a highly crystalline homopolymer, such as nylon 66 or nylon 6 polymer, which is commonly used in the production of nylon tire yarns. While the $\overline{M}w$ may be of any value that permits melt-spinning of the nylon polymer, the best results (i.e. highest tenacities) are obtained by using nylon polymers having $\overline{M}w$ values as high as possible without sacrificing melt-spinning performance. The nylon polymer, of course, must contain a SSP catalyst. Such catalysts are well-known in the art. preferred catalysts for use in practicing the invention are phosphorus compounds such as those described in U.S. Pat. No. 3,551,548, for example, phenylphosphonic acid, phenylphosphinic acid and diphenylphosphinic acid. The catalyst may be incorporated into the nylon polymer in a conventional manner, for example, by adding the catalyst to the nylon-forming monomers prior to melt polymerization thereof or to molten nylon polymer that is then either melt-spun directly into yarn or extruded and cut to flake that is later melt-spun into yarn. The amount of catalyst incorporated into the nylon polymer will depend on such factors as the particular nylon and catalyst being used. In general, the amount required will be that amount that must be added to the polymer to provide from 200 to 2000 ppm of phosphorus, based on the weight of polymer.

The melt spinning step of the process may be carried out using conventional melt-spinning conditions. Preferably, conditions, such as polymer $\overline{M}w$ and spinning speed, are selected so as so minimize orientation of the resulting as-spun yarn.

The solid state polymerization step of the process may also be carried out using conventional nylon SSP conditions, for example by heating the catalyst-containing nylon as-spun yarn in an atmosphere that is inert with respect to nylon (e.g. nitrogen) under conditions of time and temperature selected to increase the $\overline{M}w$ of the nylon polymer to a value of at least 70,000, whereby the necessary change in the morphology characteristics of the nylon are obtained. When the $\overline{M}w$ values are less than about 70,000 the as-spun yarn usually does not achieve the necessary morphology characteristics that will permit the yarn to be drawn sufficiently to attain a tenacity of at least 10 gpd. In general, the highest tenacities are obtained when the $\overline{M}w$ of the as-spun nylon is in the range of 100,000 to 300,000. In the case of as-spun nylon 66 yarns, suitable SSP temperatures are in the range of 200° C. to 245° C. and the reaction times are 3 hours or less. In general, increasing the concentration of SSP catalyst in the nylon polymer reduces reaction time and/or increases the $\overline{M}w$ of the nylon polymer. According to one embodiment of the invention, the as-spun yarn is piddled into a chamber having an inlet passage for receiving heated nitrogen and a plurality of small outlet openings through which gases may pass from the chamber. In operation, a nitrogen sweep of the yarn is provided by passing nitrogen at a selected temperature (e.g. 240° C.) through the inlet passage into the vessel where it flows over yarn surfaces and exits the chamber through the outlet openings. In this way moisture formed as a by-product of the SSP is quickly and effectively removed from contact with the yarn via the outlet openings. Of course, other techniques and equipment may be used to accomplish equivalent results.

The following examples are given for purposes of further illustrating the invention.

EXAMPLE 1

In this example high tenacity nylon 66 yarn is prepared in accordance with the present invention.

Nylon 66 polymer in flake form containing 300 ppm of phosphorus added as benzene phosphinic acid and having a $\overline{M}w$ of about 32,000 and balanced amine and carboxyl end groups is melt-spun in a conventional manner to provide an as-spun yarn. Five pounds of the yarn is piddled into a stainless steel cylindrical container having an inside diameter of 15 inches (38.10 cm) and a height of 12 inches (30.48 cm). The container has a plurality of small openings each measuring about 0.40 inches (1 cm) in diameter and an inlet opening in the top through which is fitted a ½ inch (1.27 cm) hose. The outlet end of the hose is positioned so that it is covered by the yarn and the inlet end is attached to a nitrogen source. Nitrogen at a pressure sufficient to provide a nitrogen flow of 18 cfh (0.51cmh) and at a temperature of 240° C. is fed into the chamber via the hose, passes over the yarn surfaces and then exits the chamber through the small openings. After a period of time the flow of nitrogen is discontinued, the yarn cooled and removed from the chamber. The yarn has a Mw of 100,900 and displays two crystalline endotherms in DSC analysis, one at 240.0° C. and one at 257.9° C. Samples of the yarn are then drawn between two sets of rolls at various draw ratios and temperatures recited in Table 1. In the drawing of yarn samples, the yarn is passed through a slot in a heated metal block measuring 12 inches (30.48 cm) in length and 4 inches (10.16 cm) in thickness. The slot is 1 inch (2.54 cm) in diameter. The temperature given in Table 1 is the temperature of the block. The yarn is collected at a speed of 27 ypm (24.68 mpm). The temperature of the yarn is below the softening point of the yarn. The tenacity of each yarn is determined and is given in Table 1. For purposes of comparison tenacities are given for corresponding yarns that are not subject to SSP.

TABLE 1

| Yarn Sample | SSP Time, hrs | SSP Temp. °C. | Draw Ratio | Block Temp. °C. | Tenacity gpd |
|---|---|---|---|---|---|
| 1 | none | none | 5.7 | 400 | 8.9 |
| 2 | none | none | 5.7 | 440 | 9.3 |
| 3 | none | none | 5.7 | 480 | 8.6 |
| 4 | 2 | 240 | 6.3 | 480 | 8.6 |
| 5 | 2 | 240 | 6.3 | 500 | 10.4 |
| 6 | 2 | 240 | 6.6 | 540 | 10.7 |
| 7 | 3 | 240 | 6.1 | 440 | 10.9 |
| 8 | 3 | 240 | 6.4 | 480 | 10.7 |
| 9 | 3 | 240 | 6.6 | 540 | 10.8 |

In related experiments, the Wide Angle X-Ray Scattering (WAXS) and densities of the solid state polymerized as-spun yarns ($\overline{M}w$ is 100,900) before and after drawing (Invention) are measured by conventional techniques and compared with those of the corresponding as-spun and drawn yarn that are not subjected to SSP (Control). The results are given in Table 2.

TABLE 2

| Yarn Type | Control Spun | Invention Spun | Control Drawn | Invention Drawn |
|---|---|---|---|---|
| Treatment After Spinning | None | SSP | Drawing | SSP & Drawing |
| Density (g/cc) | 1.1385 | 1.1507 | 1.1478 | 1.1525 |
| Crystalline Perfection Index (%) | 68.9 | 83.9 | 79.6 | 82.6 |
| Width (D100 · D010) $Å^2$ | 1429 | 2165 | 858 | 629 |
| Orientation (%) | — | — | 0.958 | 0.948 |

The results of Table 2 show that the as-spun yarns of the present invention are characterized in having densities, crystalline perfections, and crystalline widths all of which are greater than those of conventional as-spun yarns.

EXAMPLE 2

As-spun yarn of the present invention is produced and subjected to SSp as described in Example 1. The yarn is then drawn on a modified draw-twister. The draw-twister is of the type shown in the drawing of U.S. Pat. No. 3,009,308 and is modified as follows:

(1) heater plates, each measuring 30.48 cm in length, are positioned along the yarn path as follows:
  (a) one plate above the feed roll,
  (b) one plate between the draw pin and draw roll, and
  (c) one plate between the draw roll and balloon guide;
(2) heating of the draw pin and draw roll; and
(3) replacement of the ring-and-traveler winding mechanism with a parallel take-up winder.

In operation heater plate (1)(a) is controlled at 245° C., heater plate (1)(b) is controlled at 230° C., heater plate (1)(c) is controlled at 220° C., the draw pin is controlled at 162° C. and the draw roll is controlled at 200° C. The peripheral speed of the feed roll is 274.32 mpm (300 ypm). Several samples of the yarn at different draw ratios are collected. Also, a sample of the as-spun yarn which is not subjected to SSP is drawn using the highest possible draw ratio that can be used without causing significant filament breaks. Yarn properties are shown in Table 3.

TABLE 3

| Sample | SSP | Draw Ratio | Denier | Strength (grams.) | Elongation (percent) | Tenacity (g/d) |
|---|---|---|---|---|---|---|
| 1 | yes | 5.95 | 1391 | 12749 | 13.6 | 9.16 |
| 2 | yes | 6.23 | 1367 | 13221 | 15.6 | 9.67 |
| 3 | yes | 6.68 | 1294 | 14021 | 13.8 | 10.83 |
| 4 | yes | 6.98 | 1260 | 14503 | 14.6 | 11.51 |
| 5 | no | 5.80 | 1454 | 14292 | 12.5 | 9.82 |

The results in Table 3 show that as-spun yarn which is subjected to SSP in accordance with the process of the invention provides yarn which is capable (samples 3 and 4) of being drawn to attain high tenacity yarn. Samples 1 and 2 are not fully drawn, whereas Sample 5 is fully drawn.

What is claimed is:

1. An undrawn solid-state polymerized as-spun nylon yarn characterized in that said nylon has a Mw of at least 70,000 and displays two cyrstalline endotherms by DSC analysis.

2. The yarn of claim 1 wherein said nylon is nylon 66.

3. A drawn solid stat polymerized nylon yarn characterized in that said nylon has a $\overline{M}w$ of at least 70,000 and said yarn has a tenacity of at least 10 gpd.

4. The yarn of claim 3 wherein said yarn has a tenacity of at least 11 gpd.

5. The yarn of claim 3 wherein said nylon is nylon 66.

6. The yarn of claim 1 wherein said $\overline{M}w$ is at least 100,000.

7. The yarn of claim 3 wherein said $\overline{M}w$ is at least 100,000.

* * * * *